US010006226B2

(12) United States Patent
Hill et al.

(10) Patent No.: US 10,006,226 B2
(45) Date of Patent: Jun. 26, 2018

(54) ADJUSTABLE BACKSET CYLINDRICAL LATCH

(71) Applicant: Yale Security Inc., Monroe, NC (US)

(72) Inventors: Christopher Hill, New Britain, CT (US); Todd Zimmer, Meriden, CT (US); Brian R. Fournier, Canton, CT (US); Christine E. Voelker, East Hampton, CT (US); William S. Middelaer, Simsbury, CT (US)

(73) Assignee: YALE SECURITY INC., Monroe, NC (US)

( * ) Notice: Subject to any disclaimer, the term of this patent is extended or adjusted under 35 U.S.C. 154(b) by 38 days.

(21) Appl. No.: 15/204,161

(22) Filed: Jul. 7, 2016

(65) Prior Publication Data

US 2017/0009490 A1 Jan. 12, 2017

Related U.S. Application Data

(60) Provisional application No. 62/189,458, filed on Jul. 7, 2015.

(51) Int. Cl.
*E05C 1/00* (2006.01)
*E05B 63/06* (2006.01)
(Continued)

(52) U.S. Cl.
CPC ..... *E05B 63/06* (2013.01); *E05B 55/005* (2013.01); *E05B 65/06* (2013.01); *E05C 1/163* (2013.01)

(58) Field of Classification Search
CPC ..... E05B 63/06; E05B 65/06; E05B 55/005; E05C 1/163
See application file for complete search history.

(56) References Cited

U.S. PATENT DOCUMENTS 4,664,433 A 5/1987 Solovieff
4,725,086 A 2/1988 Shen
(Continued)

FOREIGN PATENT DOCUMENTS

WO 2007001311 A1 1/2007

OTHER PUBLICATIONS

Yale Security Inc., International Application No. PCT/US2016/041267, International Search Report and Written Opinion, Sep. 16, 2016.

(Continued)

*Primary Examiner* — Jerry E Redman
(74) *Attorney, Agent, or Firm* — Dennis J. Williamson; Moore & Van Allen PLLC

(57) ABSTRACT

A latch assembly comprises a latch bolt and a tailpiece including a first tailpiece member mounted to the latch bolt and a second tailpiece member. The second tailpiece member is movably received in a bore of the first tailpiece member and operably connected to a latch operator. The second tailpiece member is received in one of two axially spaced recesses in the bore in a first backset position and a second backset position. Relative axial movement between the first tailpiece member and the second tailpiece member is prevented in a first relative rotational position in the first backset position and in a second relative rotational position in the second backset position, and relative axial movement is allowed in a third relative rotational position to allow the second tailpiece member to be moved between the first backset position and the second backset position. A housing slidably receives the latch bolt therein and a casing defining a peripheral slot having two axially spaced circumferential portions interconnected by a longitudinal portion receives the housing such that a protrusion on the housing is slidably received in the slot. Relative axial movement between the casing and the housing is prevented when the protrusion is in either one of the two circumferential portions of the slot in a first rotational position in the first backset position and in a second rotational position in the second backset position, and relative axial movement is allowed in a third rotational position to allow the protrusion on the housing to be movable along the longitudinal passage between the
(Continued)

circumferential portions of the slot when transitioning between the first backset position and the second backset position.

9 Claims, 17 Drawing Sheets

(51) Int. Cl.

| | |
|---|---|
| ***E05B 55/00*** | (2006.01) |
| ***E05B 65/06*** | (2006.01) |
| ***E05C 1/16*** | (2006.01) |

(56) References Cited

U.S. PATENT DOCUMENTS

| | | | | |
|---|---|---|---|---|
| 4,752,090 | A | 6/1988 | Lin | |
| 4,767,140 | A | 8/1988 | Lin | |
| 4,979,768 | A | 12/1990 | Marotto et al. | |
| 5,169,184 | A | 12/1992 | Bishop | |
| 5,364,138 | A | 11/1994 | Dietrich et al. | |
| 5,489,128 | A | 2/1996 | Florian | |
| 5,957,510 | A | 9/1999 | Kuo | |
| 7,695,032 | B2 | 4/2010 | Bodily | |
| 8,360,482 | B2 | 1/2013 | Viviano | |
| 2007/0052250 | A1 | 3/2007 | Bodily et al. | |
| 2009/0152875 | A1* | 6/2009 | Gray | E05B 55/005 292/1.5 |
| 2016/0215525 | A1* | 7/2016 | Ramakrishna | E05B 63/06 |
| 2017/0009490 | A1* | 1/2017 | Hill | E05B 55/005 |
| 2017/0275926 | A1* | 9/2017 | Kumar | E05B 63/06 |

OTHER PUBLICATIONS

International Bureau of WIPO; International Preliminary Report on Patentability for International Patent Application No. PCT/US2016/041267 dated Jan. 18, 2018, 13 Pages.

* cited by examiner

ADJUSTABLE BACKSET CYLINDRICAL LATCH

CROSS-REFERENCE

This application is related to U.S. provisional application No. 62/189,458, filed Jul. 7, 2015, entitled "ADJUSTABLE BACKSET CYLINDRICAL LATCH", naming Christopher Hill, Todd Zimmer, Brian R. Fournier, Christine E. Voelker, and William S. Middelaer as the inventors. The contents of the provisional application are incorporated herein by reference in their entirety, and the benefit of the filing date of the provisional application is hereby claimed for all purposes that are legally served by such claim for the benefit of the filing date.

BACKGROUND

An adjustable backset cylindrical latch is described and, more particularly, an adjustable backset cylindrical latch for use in a lockset for use with doors having different backset distances.

"Backset" is the distance between the edge of a door and the transverse axis of rotation about which a latch operator moves for extending and retracting a latch bolt. Backset has been standardized by the industry, wherein standard backsets for commercial door openings are 2⅜ inches and 2¾ inches. Adjustable backset latch mechanisms have become an accepted feature of tubular locksets.

SUMMARY

A latch assembly is provided for installation at more than one backset distance relative to a latch operator. The latch assembly comprises a latch bolt and a tailpiece. The tailpiece includes a first tailpiece member having a first end mounted to the latch bolt and a second tailpiece member. The first tailpiece member defines a longitudinal bore having two axially spaced transverse recesses interconnected by a longitudinal passage. The second tailpiece member has a first end configured to be movably received in the bore of the first tailpiece member and a second end adapted to be operably connected to the latch operator. The first end of the second tailpiece member is received in one of the two axially spaced recesses in a first backset position and in the second of the two axially spaced recesses in a second backset position such that the second end of the second tailpiece member is axially spaced relative to the first tailpiece member from the first backset position. The second tailpiece member is rotatable relative to the first tailpiece member, wherein relative axial movement between the first tailpiece member and the second tailpiece member is prevented in a first rotational position in the first backset position and in a second rotational position in the second backset position. Relative axial movement of the second tailpiece member relative to the first tailpiece member is allowed in a third rotational position to allow the second tailpiece member to be movable along the longitudinal passage between the first backset position and the second backset position. A housing slidably receives the latch bolt therein. The housing includes a transversely extending protrusion. A casing defining a peripheral slot has two axially spaced circumferential portions interconnected by a longitudinal portion. The casing is configured for receiving the housing such that the protrusion on the housing is slidably received in the slot. The protrusion is received in one of the two axially circumferential portions in the first backset position and in the second of the two axially spaced circumferential portions in the second backset position such that the casing is axially spaced relative to the latch bolt from the first backset position. The casing is rotatable relative to the housing, wherein relative axial movement between the casing and the housing is prevented when the protrusion is in either one of the two circumferential portions of the slot in a first rotational position in the first backset position and in a second rotational position in the second backset position. Relative axial movement of the casing relative to the housing is allowed in a third rotational position to allow the protrusion on the housing to be movable along the longitudinal passage between the circumferential portions of the slot when transitioning between the first backset position and the second backset position.

A lockset is provided for use in an edge of a swinging door. The lockset comprises a latch operator having a rotational axis and a latch assembly for installation at more than one backset distance relative to the rotational axis of the latch operator. The latch assembly comprises a latch bolt and a tailpiece including a first tailpiece member having a first end mounted to the latch bolt and a second tailpiece member. The first tailpiece member defines a longitudinal bore having two axially spaced transverse recesses interconnected by a longitudinal passage. The second tailpiece member has a first end configured to be movably received in the bore of the first tailpiece member and a second end adapted to be operably connected to the latch operator. The first end of the second tailpiece member is received in one of the two axially spaced recesses in a first backset position and in the second of the two axially spaced recesses in a second backset position such that the second end of the second tailpiece member is axially spaced relative to the first tailpiece member from the first backset position. The second tailpiece member being rotatable relative to the first tailpiece member, wherein relative axial movement between the first tailpiece member and the second tailpiece member is prevented in a first relative rotational position in the first backset position and a second relative rotational position in the second backset position. Relative axial movement of the second tailpiece member relative to the first tailpiece member is allowed in a third relative rotational position to allow the second tailpiece member to be movable along the longitudinal passage between the first backset position and the second backset position. A housing slidably receives the latch bolt therein. The housing includes a transversely extending protrusion and is adapted to disposed in the edge of the door. A casing defines a peripheral slot having two axially spaced circumferential portions interconnected by a longitudinal portion. The casing is adapted to be disposed in the edge of the door and configured for slidably receiving the housing such that the protrusion on the housing is received in the slot. The protrusion is received in one of the two axially circumferential portions in the first backset position and in the second of the two axially spaced circumferential portions in the second backset position such that the casing is axially spaced relative to the latch bolt from the first backset position. The casing is rotatable relative to the housing, wherein relative axial movement between the casing and the housing is prevented when the protrusion is in either one of the two circumferential portions of the slot in a first relative rotational position in the first backset position and a second relative rotational position in the second backset position. Relative axial movement of the casing relative to the housing is allowed in a third rotational position to allow the protrusion on the housing to be movable along the longitudinal passage between the circumferential portions of the slot when transitioning between the first backset position and the second backset position.

An apparatus is provided for allowing passage through an opening. The apparatus comprises a door adapted to be mounted along one edge in the opening for swinging movement between an open position and a closed position. A lockset is configured to be disposed in an edge of the door opposite the mounted edge. The lockset comprises a latch operator having a rotational axis and a latch assembly for installation at more than one backset distance relative to the rotational axis of the latch operator. The latch assembly comprises a latch bolt and a tailpiece including a first tailpiece member having a first end mounted to the latch bolt and a second tailpiece member. The first tailpiece member defines a longitudinal bore having two axially spaced transverse recesses interconnected by a longitudinal passage. The first end of the second tailpiece member is configured to be movably received in the bore of the first tailpiece member and a second end adapted to be operably connected to the latch operator. The first end of the second tailpiece member is received in one of the two axially spaced recesses in a first backset position and in the second of the two axially spaced recesses in a second backset position such that the second end of the second tailpiece member is axially spaced relative to the first tailpiece member from the first backset position. The second tailpiece member being rotatable relative to the first tailpiece member, wherein relative axial movement between the first tailpiece member and the second tailpiece member is prevented in a first relative rotational position in the first backset position and a second relative rotational position in the second backset position. Relative axial movement of the second tailpiece member relative to the first tailpiece member is allowed in a third relative rotational position to allow the second tailpiece member to be movable along the longitudinal passage between the first backset position and the second backset position. A housing including a transversely extending protrusion is disposed in the edge of the door for slidably receiving the latch bolt therein. A casing defining a peripheral slot having two axially spaced circumferential portions interconnected by a longitudinal portion is also disposed in the edge of the door and configured for slidably receiving the housing such that the protrusion on the housing is received in the slot. The protrusion is received in one of the two axially circumferential portions in the first backset position and in the second of the two axially spaced circumferential portions in the second backset position such that the casing is axially spaced relative to the latch bolt from the first backset position. The casing is rotatable relative to the housing, wherein relative axial movement between the casing and the housing is prevented when the protrusion is in either one of the two circumferential portions of the slot in a first relative rotational position in the first backset position and a second relative rotational position in the second backset position. Relative axial movement of the casing relative to the housing is allowed in a third rotational position to allow the protrusion on the housing to be movable along the longitudinal passage between the circumferential portions of the slot when transitioning between the first backset position and the second backset position.

BRIEF DESCRIPTION OF THE DRAWINGS

For a more complete understanding of the cylindrical latch, reference should now be had to the embodiments shown in the accompanying drawings and described below. In the drawings.

DESCRIPTION

Figure 1:
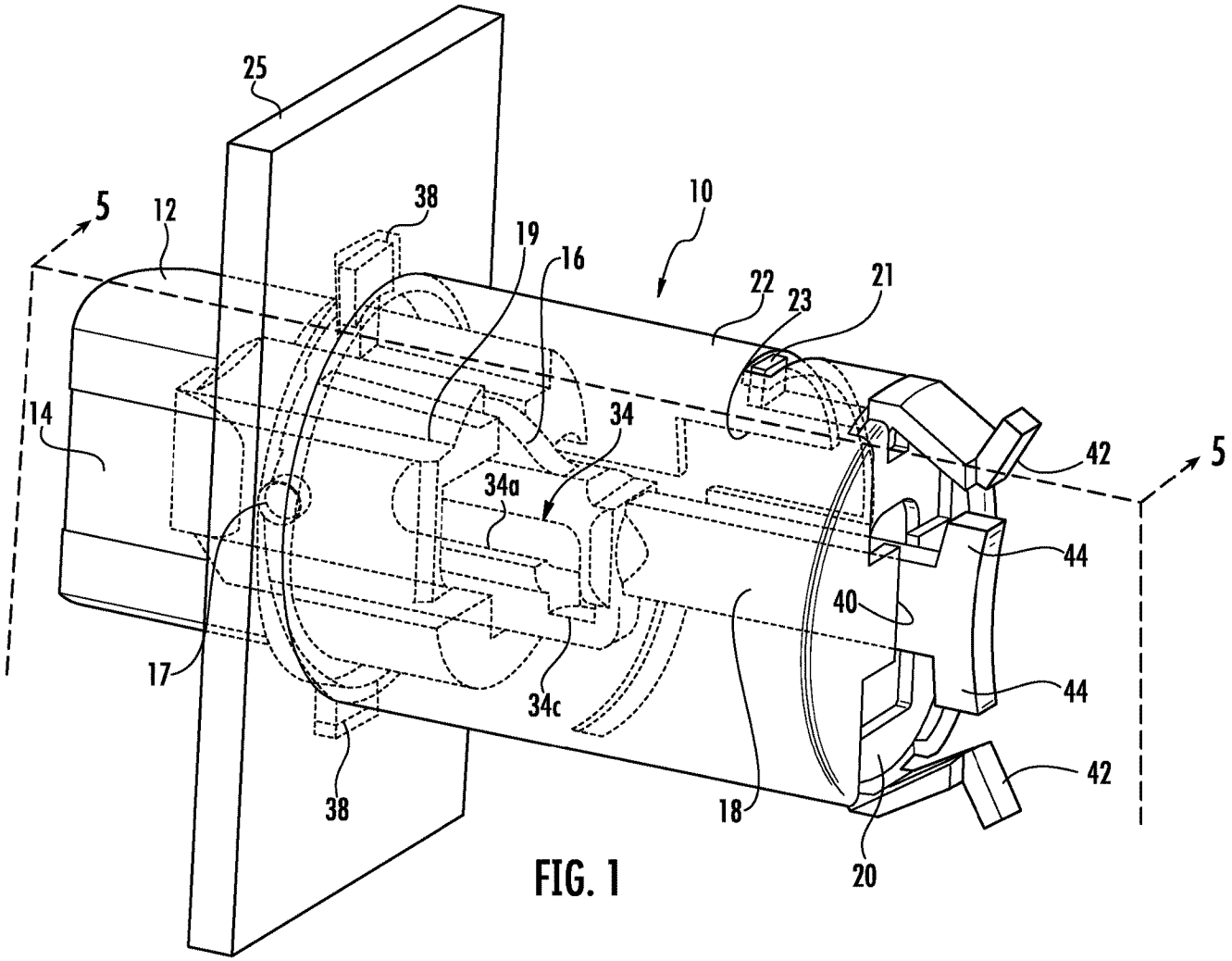
FIG. 1 is a rear perspective view of an embodiment of an adjustable backset cylindrical latch in a first position at a backset distance with a portion of the components shown in phantom.
Figure 2:
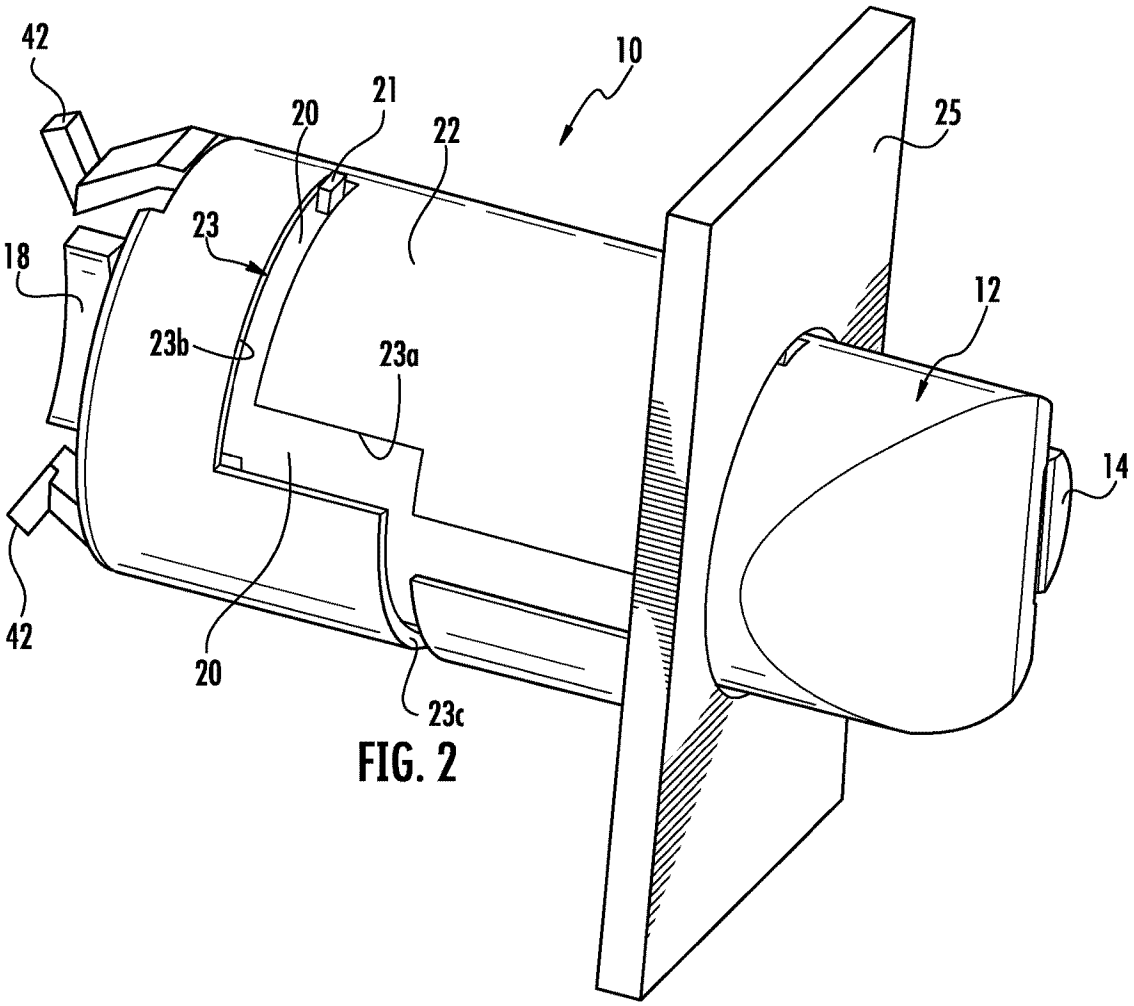
FIG. 2 is a front perspective view of the adjustable backset cylindrical latch as shown in FIG. 1.
Figure 3:
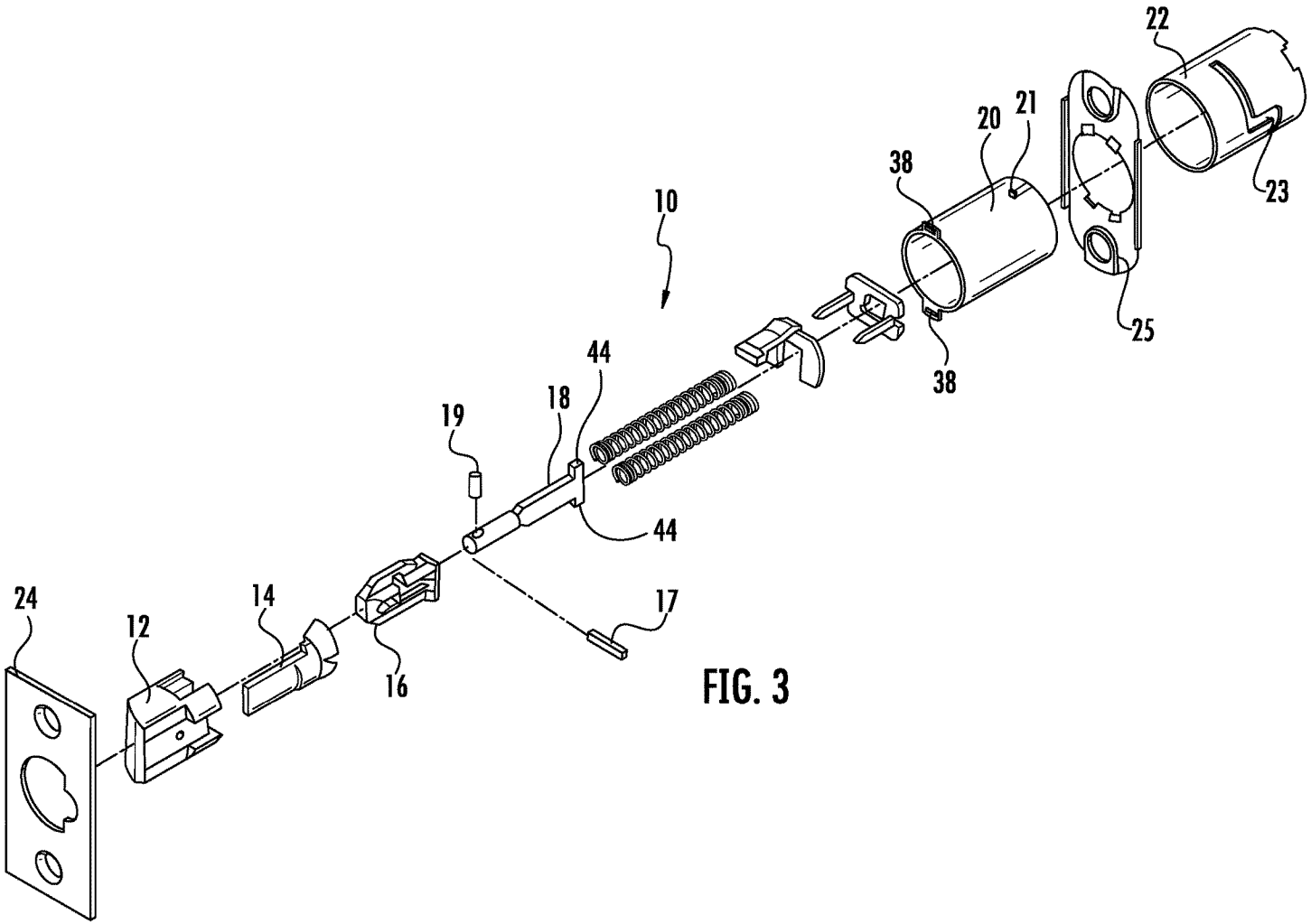
FIG. 3 is an exploded perspective view of the adjustable backset cylindrical latch as shown in FIG. 1.

The adjustable backset cylindrical latch described herein may be used in a cylindrical lockset, for example, a Grade 2 commercial lockset capable of meeting ANSI standards.

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Referring now to the drawings, wherein like reference numerals designate corresponding or similar elements throughout the several views, an embodiment of an adjustable backset cylindrical latch is shown in FIGS. 1-5 and generally designated at 10. The latch 10 comprises a bolt head 12 which is configured to extend from a face plate 24 in the edge of a door. The bolt head 12 may include a deadlatch 14 slidably associated with the bolt head 12. The inner end of the bolt head 12 defines a longitudinal slot 30 for receiving an outer tailpiece 16. The outer end of the outer tailpiece 16 defines a short longitudinal slot 31 for receiving a transverse pin 17 for securing the bolt head 12 for movement together with the outer tailpiece 16.

The outer tailpiece 16 defines an inner cylindrical longitudinal bore 32 for slidingly receiving an outer end of an inner tailpiece 18. The bore 32 defines a slot 34 having a longitudinally extending intermediate portion 34*a*. The intermediate portion 34*a* terminates at each end in an outer transverse portion 34*b* and an inner transverse portion 34*c* extending transversely of the longitudinal portion 34*a* of the slot 34. A pin 19 is disposed in the outer end of the inner tailpiece 18. The pin 19 extends transversely from the outer end of the inner tailpiece 18.

The latch 10 is housed in an open-ended cylindrical inner case 20. The inner case 20 is fixed to the inner surface of the face plate 24 by a back plate 25. The back plate 25 captures opposed transverse tabs 38 between the face plate 24 and the back plate 25.

A cylindrical outer case 22 is configured to be slidably disposed on the inner case 20. The outer case 22 defines a slot 23 having a central longitudinal portion 23*a* interconnecting an inner circumferential portion 23*b* and an outer circumferential portion 23*c*. The inner case 20 has a radial external tab 21 extending into the slot 23 in the outer case 22.

FIGS. 1, 2, 4 and 5 show the latch 10 in a first backset position at 2⅜ inches. In this position, the outer end of the inner tailpiece 18 is fully inserted into the bore 32 in the outer tailpiece 16. The inner tailpiece 18 is rotated such that the end of the pin 19 is received in the outer transverse portion 34*b* of the slot 34 of the outer tailpiece 16. The bolt head 12 and the inner tailpiece 18 are secured for axial movement together particularly upon rotation of a latch operator 28 (FIG. 16) for retraction of the bolt head 12 into the inner case and opening of the door. In the first backset position, the tab 21 on the inner case 20 is at the end of the inner circumferential portion 23*b* of the slot 23 in the outer case 22.

Figure 6:
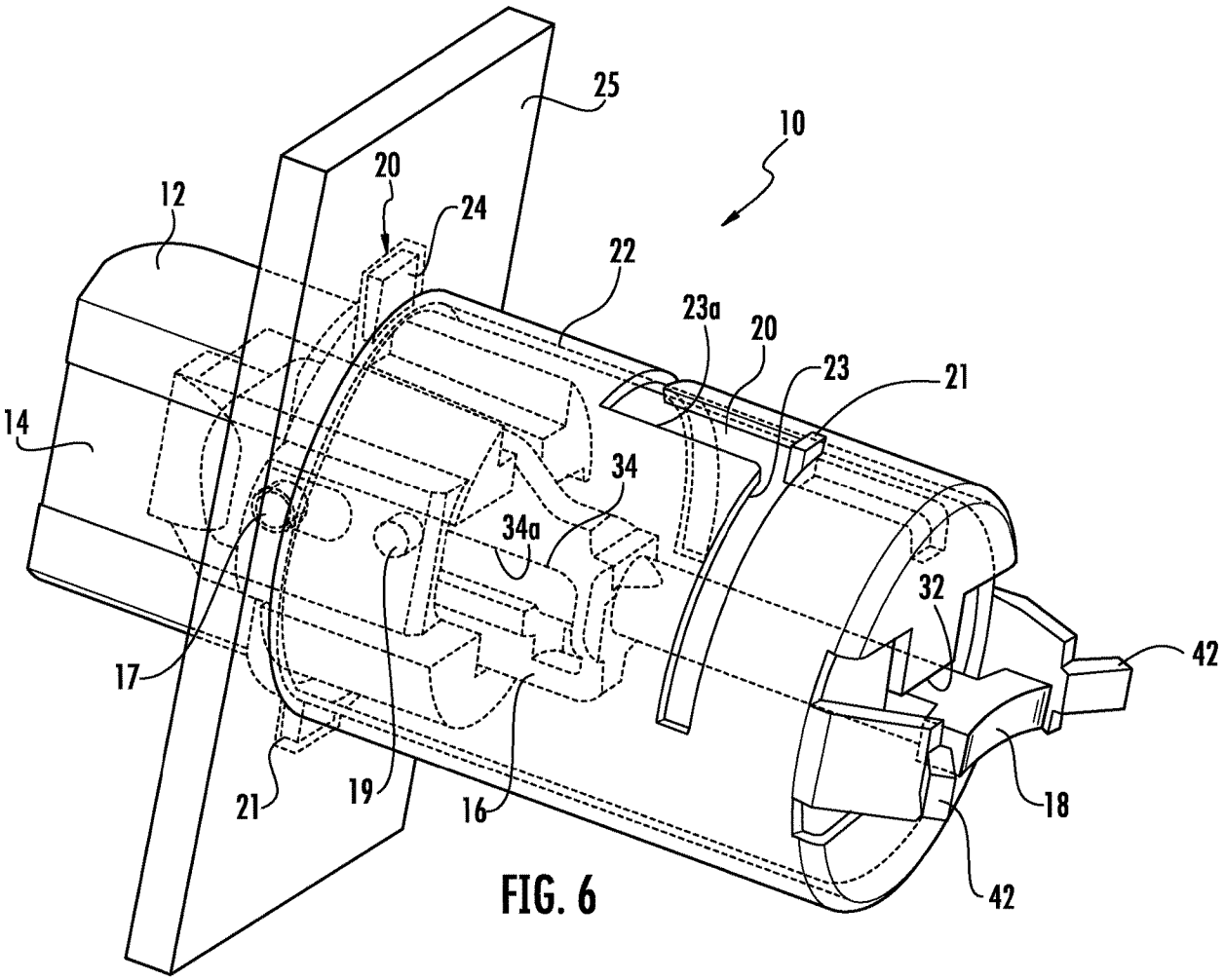
FIG. 6 is a rear perspective view of the adjustable backset cylindrical latch as shown in FIG. 1 in a second position with a portion of the components shown in phantom.
Figure 7:
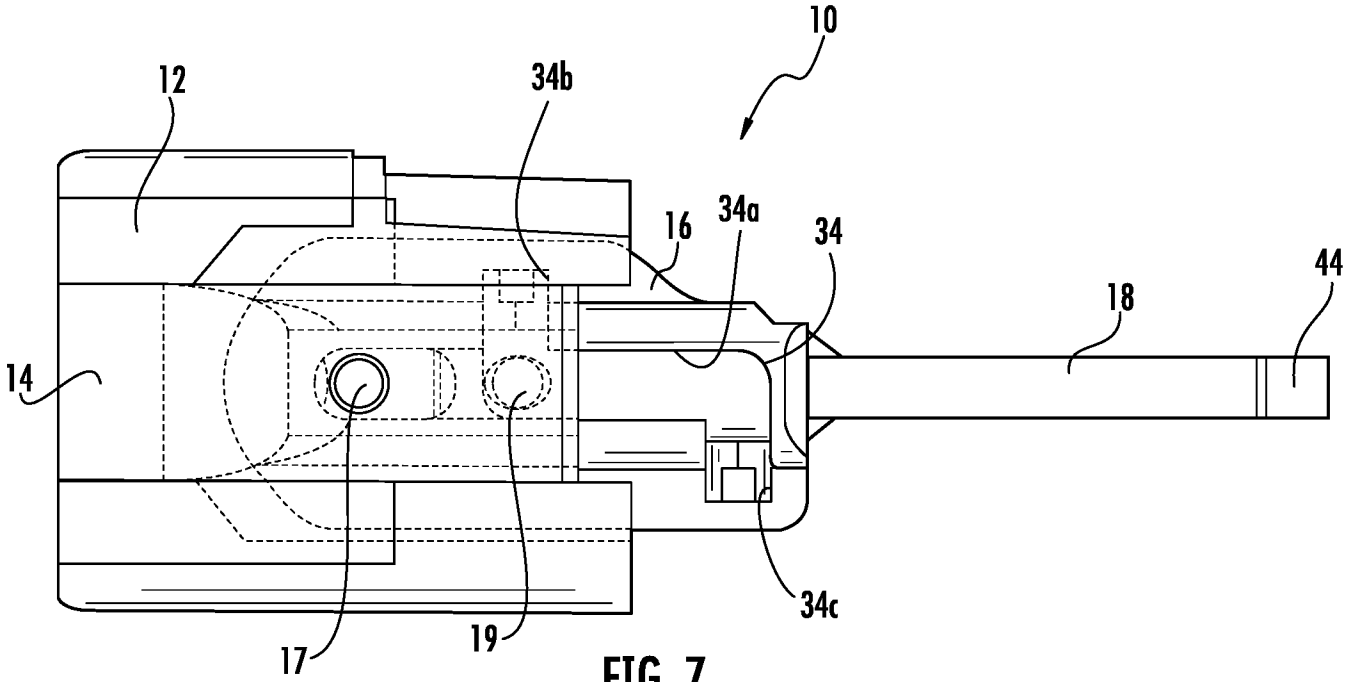
FIG. 7 is an elevation view of the cylindrical latch as shown in FIG. 4 in the second position.

To move the latch 10 to a second backset position, the inner tailpiece 18 and the outer case 22 are first rotated 90° counterclockwise to a position shown in FIGS. 6 and 7. As best shown in FIG. 1, the outer case 22 defines an inner opening 40 configured for non-rotatably passing the inner portion of the inner tailpiece 18. Thus, the inner tailpiece 18 and the outer case 22 rotate together to the 90° counterclockwise position. In this position, the pin 19 in the outer end of the inner tailpiece 18 is aligned with the longitudinal portion 34*a* of the slot 34 in the outer tailpiece 16. Similarly, the tab 21 on the inner case 20 is now aligned with the central longitudinal portion 23*a* of the slot 23 in the outer case 22 (FIG. 6). In this position, the inner tailpiece 18 and the outer case 22 are slidable in an axial direction relative to the outer tailpiece 16 and the inner case 20, respectively.

Figure 8:
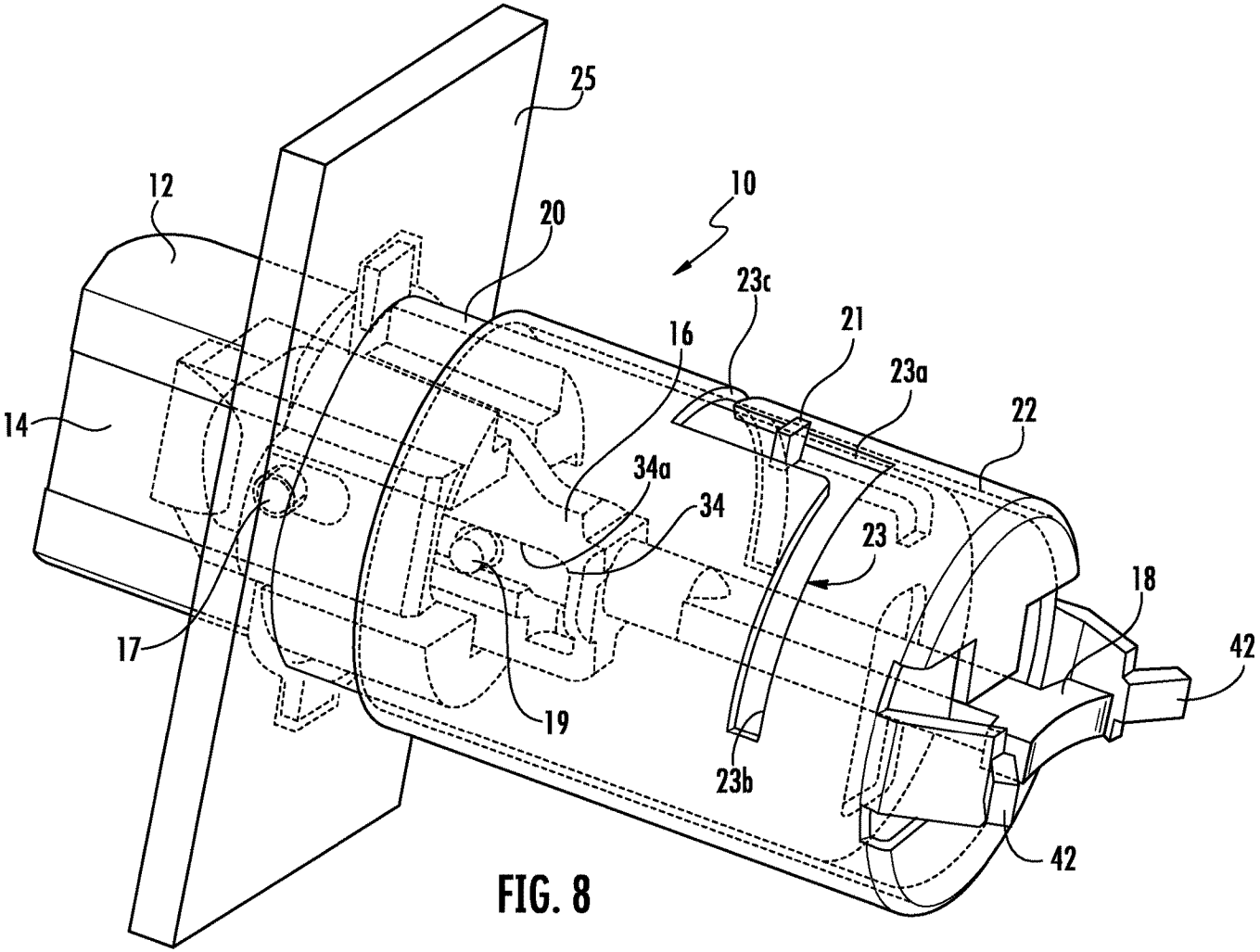
FIG. 8 is a rear perspective view of the adjustable backset cylindrical latch as shown in FIG. 1 in a third position with a portion of the components shown in phantom.
Figure 9:
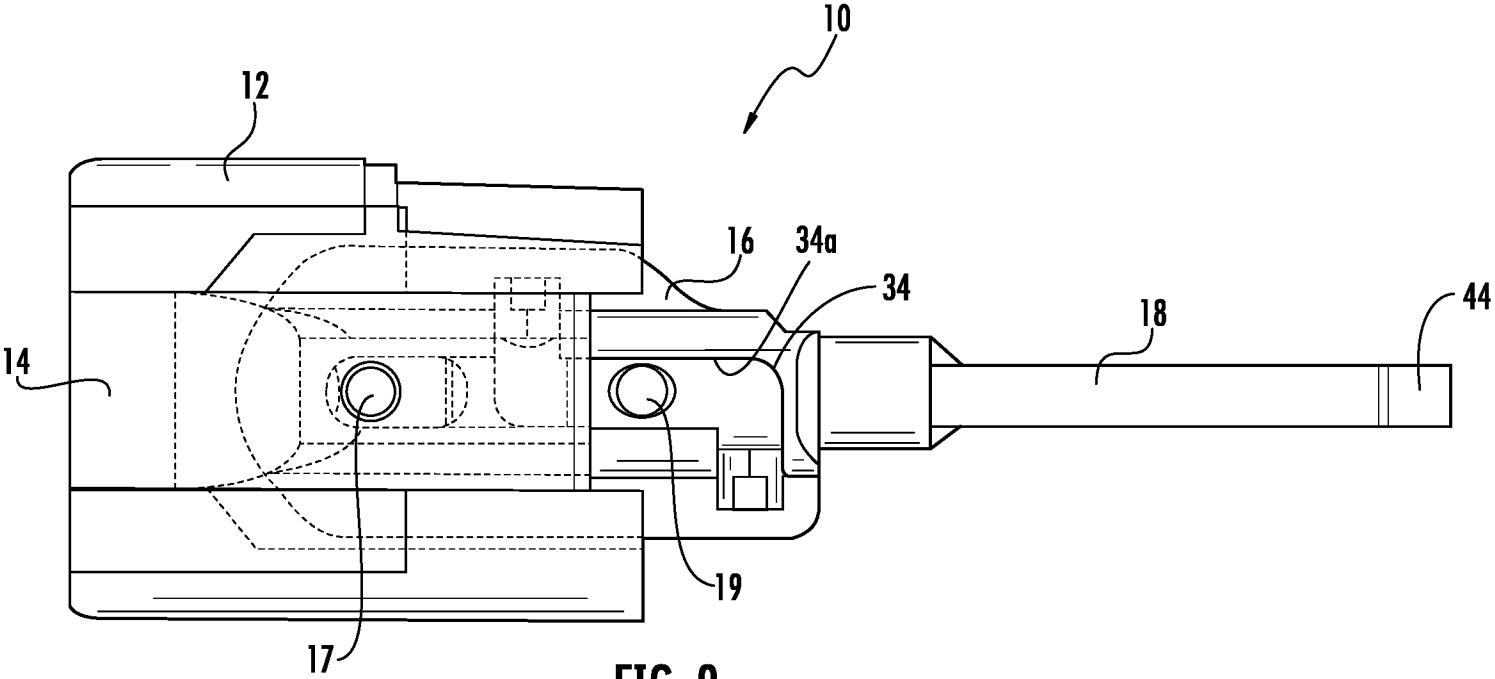
FIG. 9 is an elevation view of the cylindrical latch as shown in FIG. 4 in the third position.

FIGS. 8 and 9 show the inner tailpiece 18 with pin 19 partially advanced along the longitudinal portion 34*a* of the slot 34 towards the inner end of the bore 32 in the outer tailpiece 16. Accordingly, the tab 21 on the inner case 20 is partially advanced toward the outer circumferential portion 23*c* of the slot 23 in the outer case 22.

Figure 10:
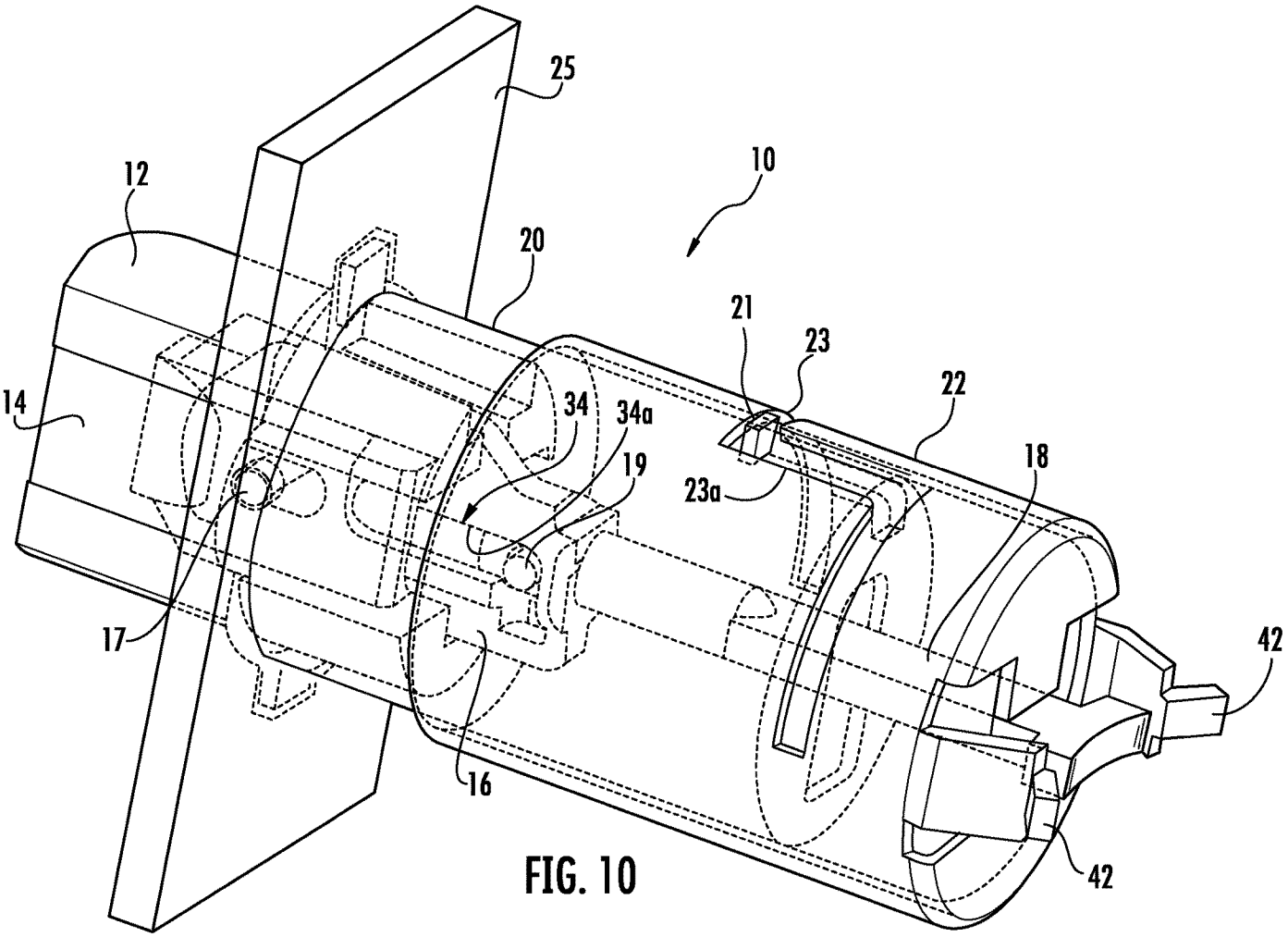
FIG. 10 is a rear perspective view of the adjustable backset cylindrical latch as shown in FIG. 1 in a fourth position with a portion of the components shown in phantom.
Figure 11:
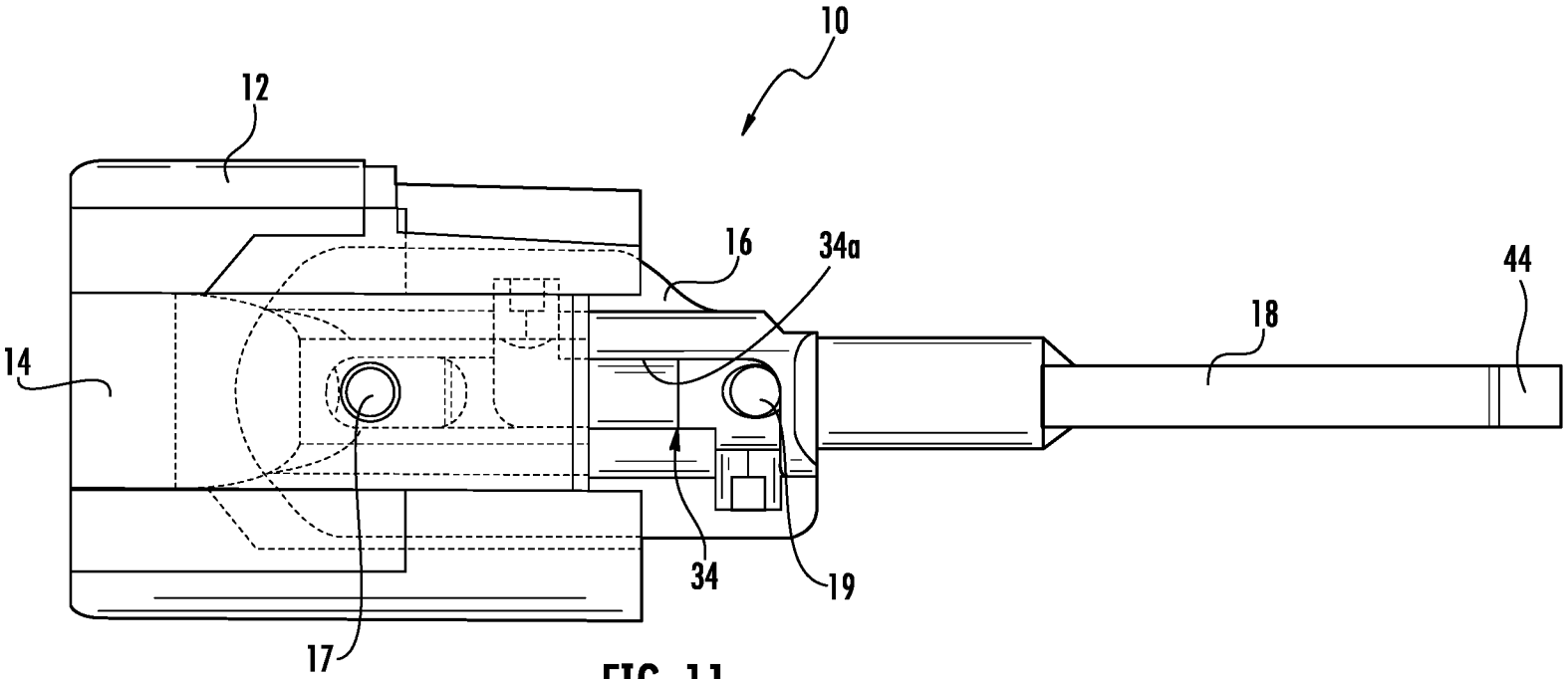
FIG. 11 is an elevation view of the cylindrical latch as shown in FIG. 4 in the fourth position.
Figure 12:
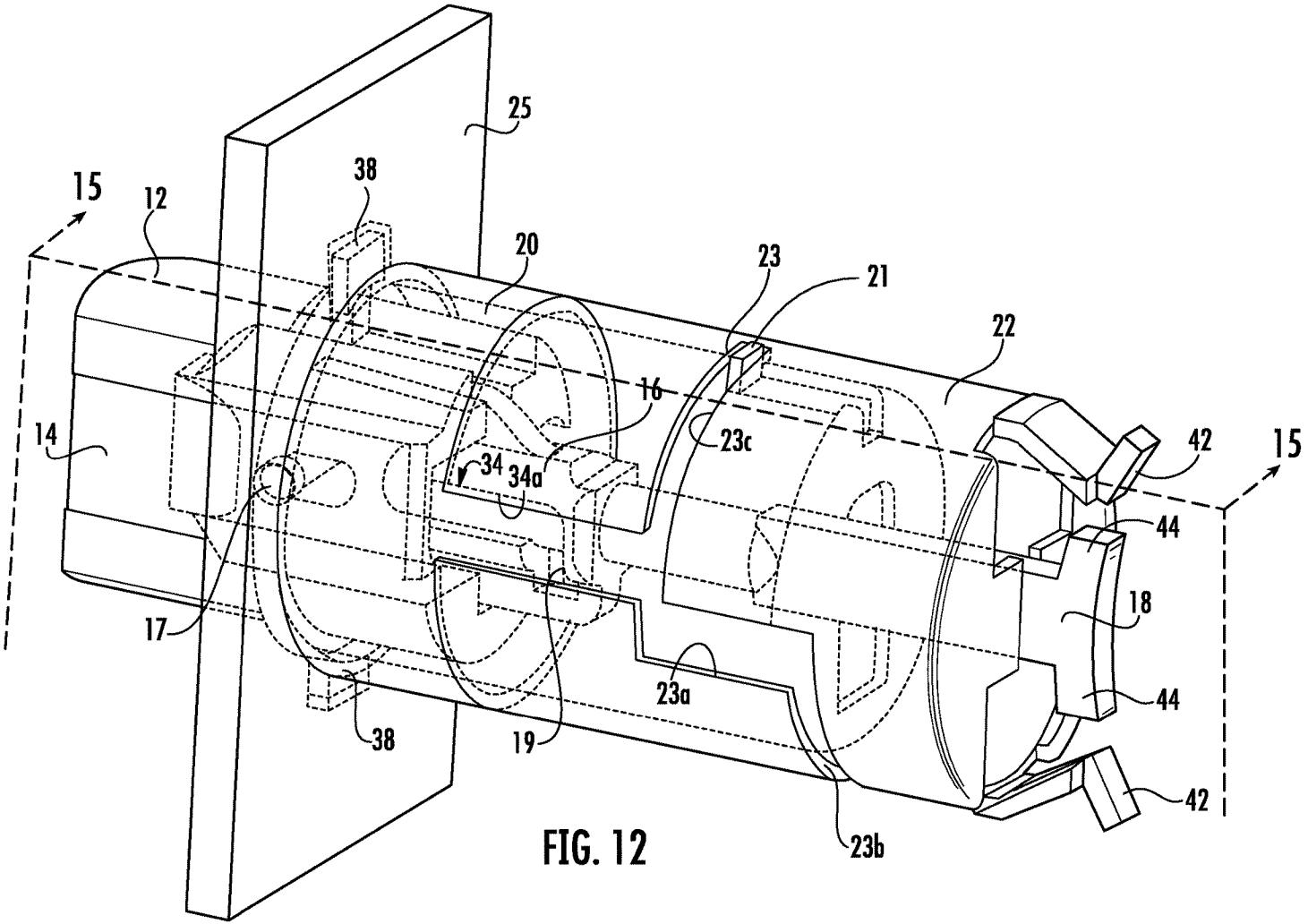
FIG. 12 is a rear perspective view of the adjustable backset cylindrical latch as shown in FIG. 1 in a fifth position at a second backset distance with a portion of the components shown in phantom.
Figure 13:
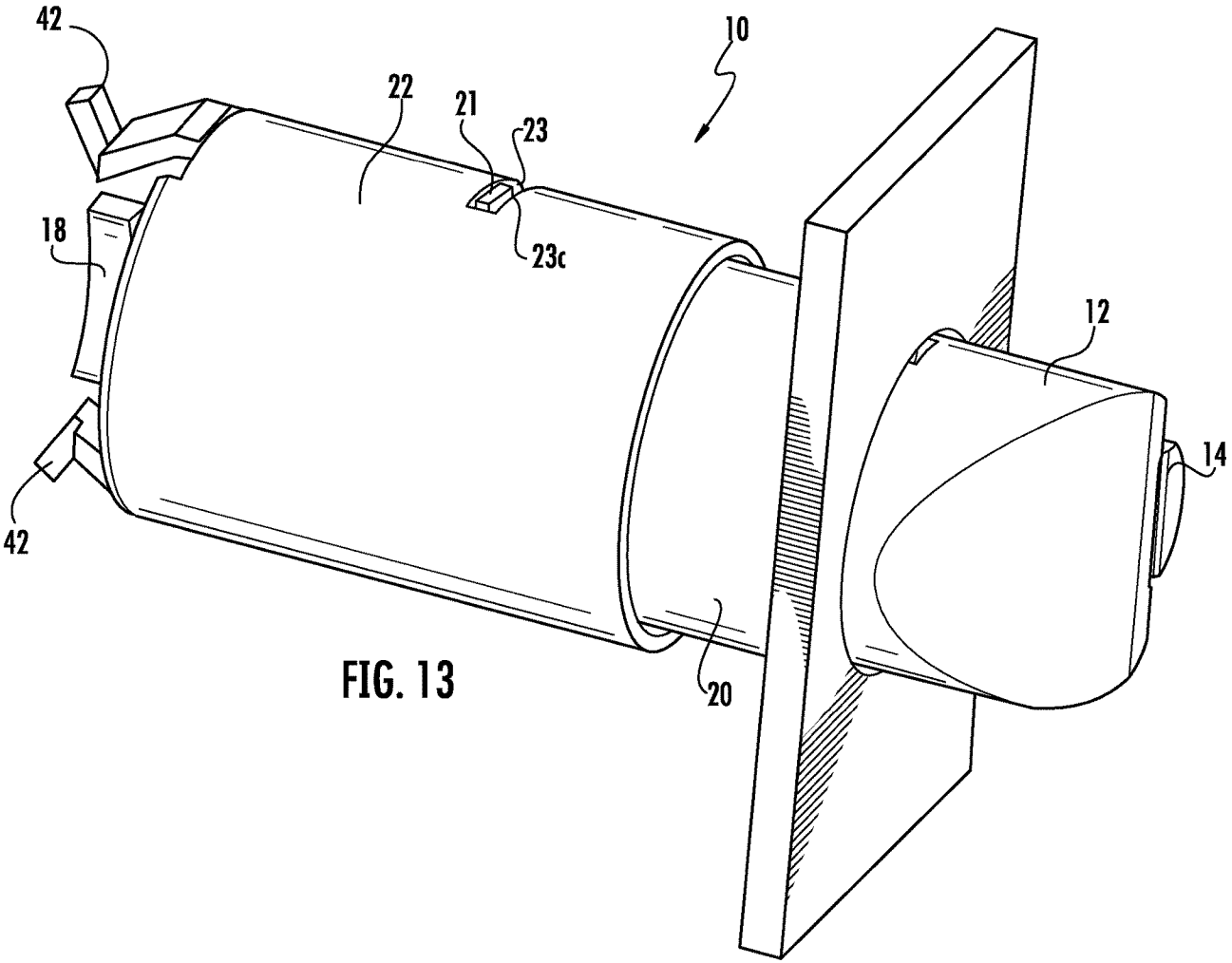
FIG. 13 is a front perspective view of the adjustable backset cylindrical latch as shown in FIG. 12.
Figure 14:
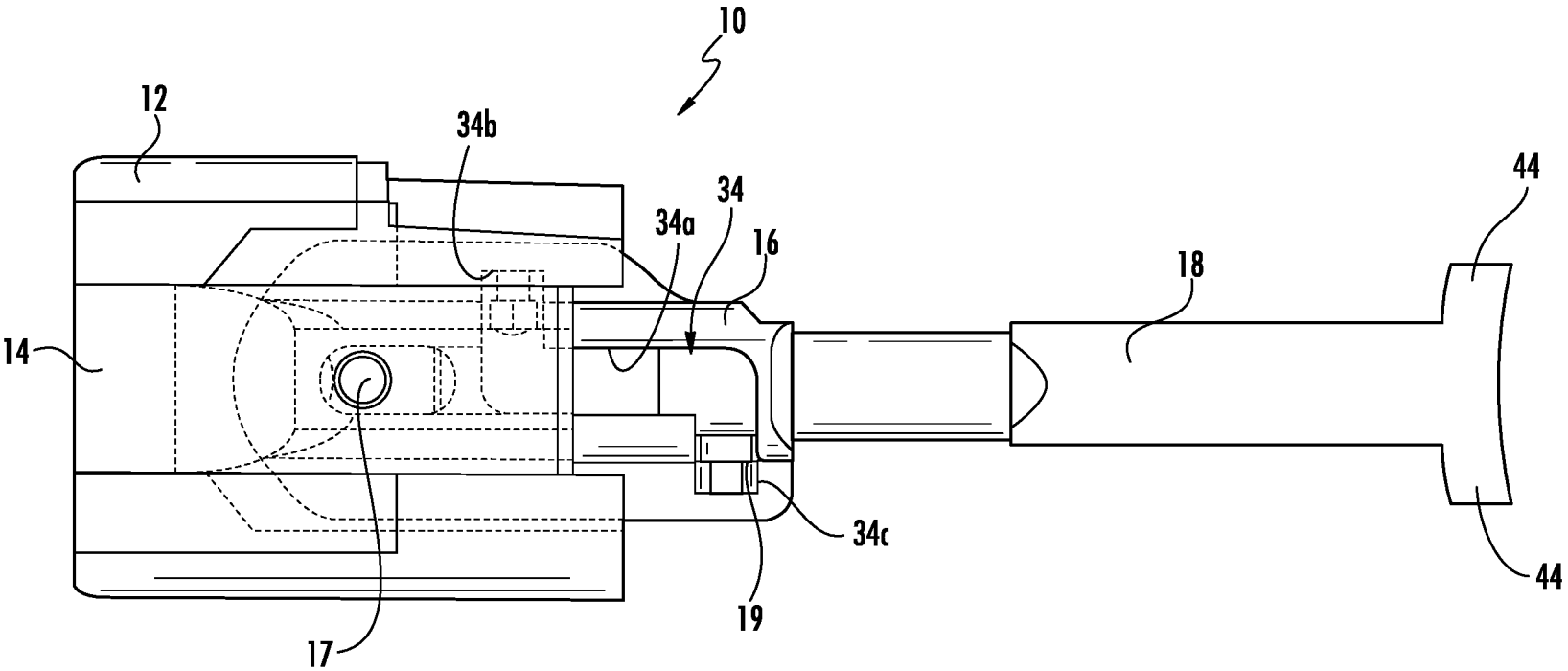
FIG. 14 is an elevation view of the cylindrical latch as shown in FIG. 4 in the fifth position.
Figure 15:
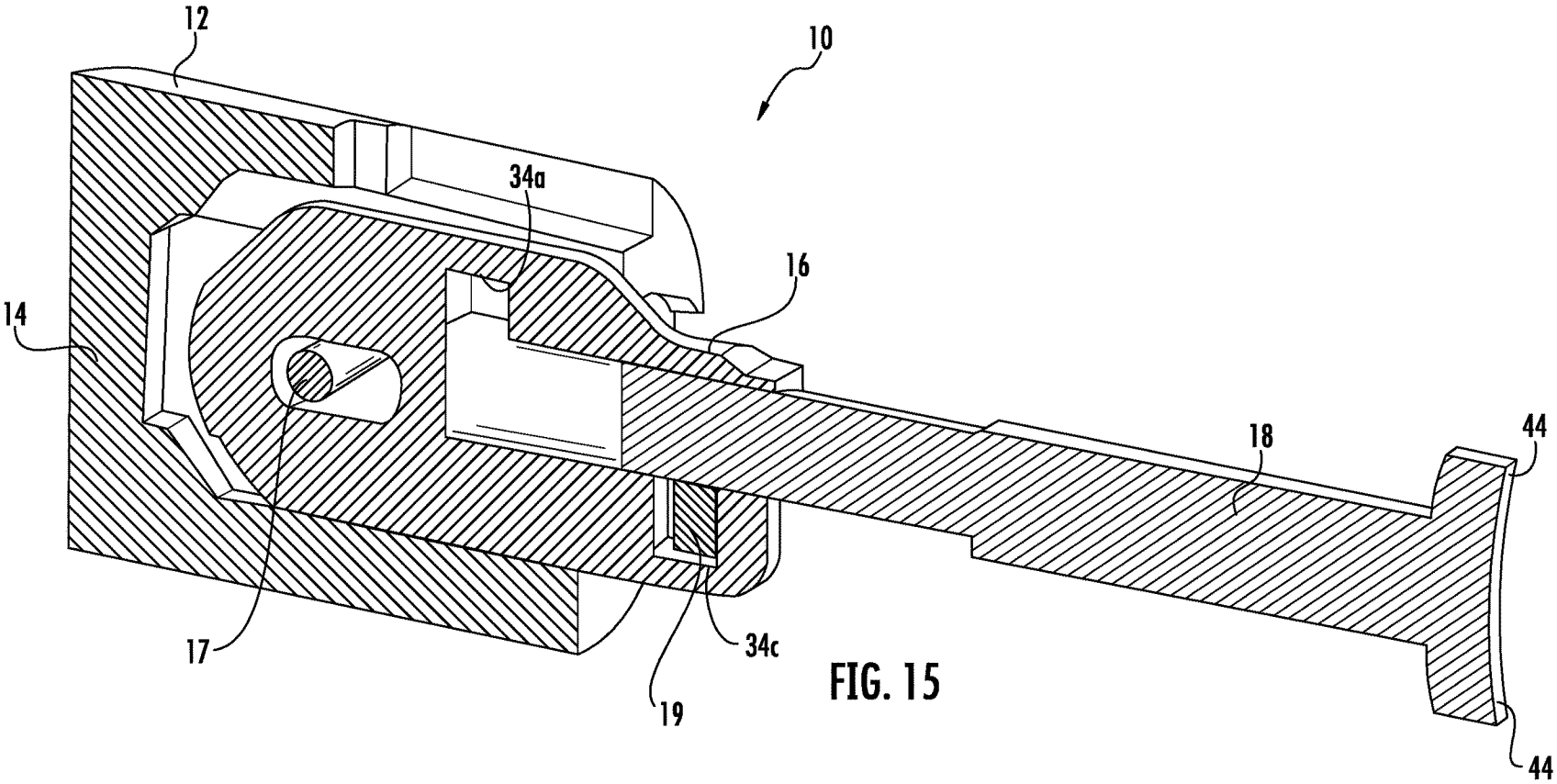
FIG. 15 is a perspective section view of the cylindrical latch as shown in FIG. 14 as taken along a vertical cutting plane 15-15 of FIG. 12 through the longitudinal axis of the cylindrical latch.

In FIGS. 10 and 11, the outer end of the inner tailpiece 18 is at the inner end of the bore 32 in the outer tailpiece 16 with pin 19 advanced to the end of longitudinal portion 34*a*. The tab 21 on the inner case 20 is at the inner end of the longitudinal portion 23*a* of the slot 23 in the outer case 22.

To complete movement of the latch 10 to the second backset position, the inner tailpiece 18 and the outer case 22 are rotated together 90° counterclockwise to the position shown in FIGS. 12-15. The pin 19 at the outer end of the inner tailpiece 18 is now in the inner transverse portion 34*c* of the slot 34 in the outer tailpiece 16. The tab 21 on the inner case 20 is disposed at the end of the outer circumferential slot 23*c* in the outer case 22. In this position, the backset distance is 2¾ inches, and the bolt head 12 and the inner tailpiece 18 are secured for axial movement together upon rotation of a latch operator 28.

Figure 4:
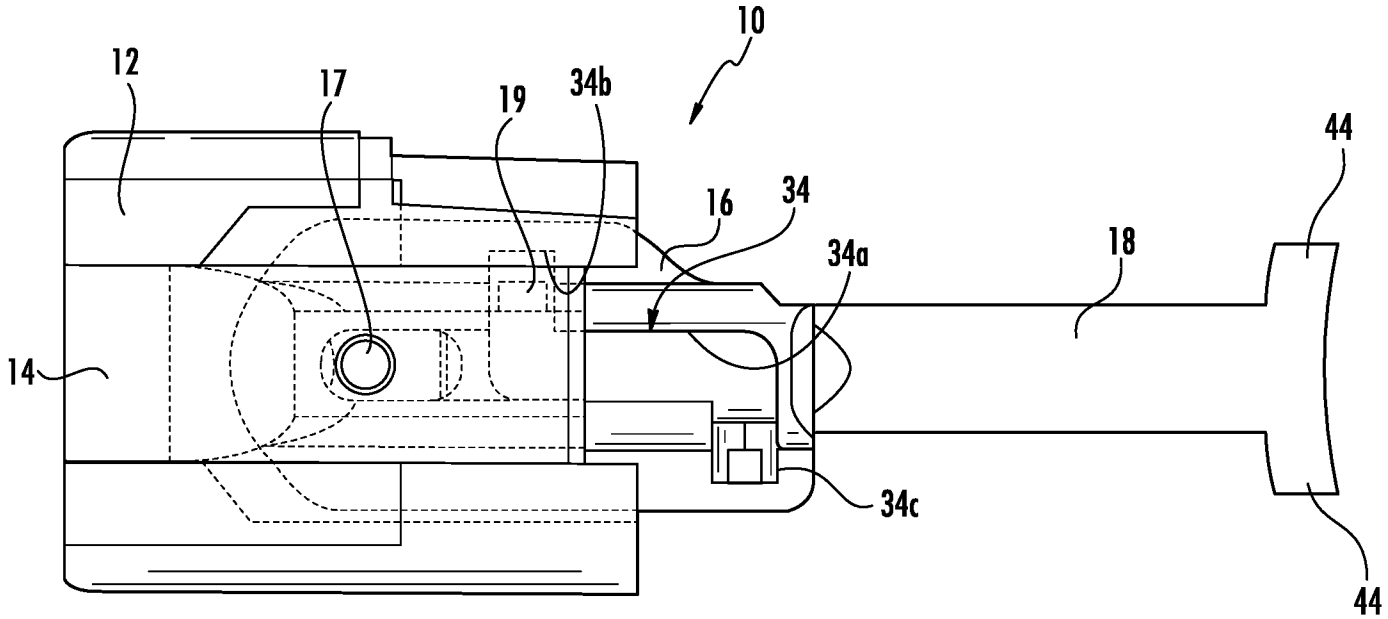
FIG. 4 is an elevation view of an embodiment of a cylindrical latch for use with the adjustable backset cylindrical latch as shown in FIG. 1.
Figure 5:
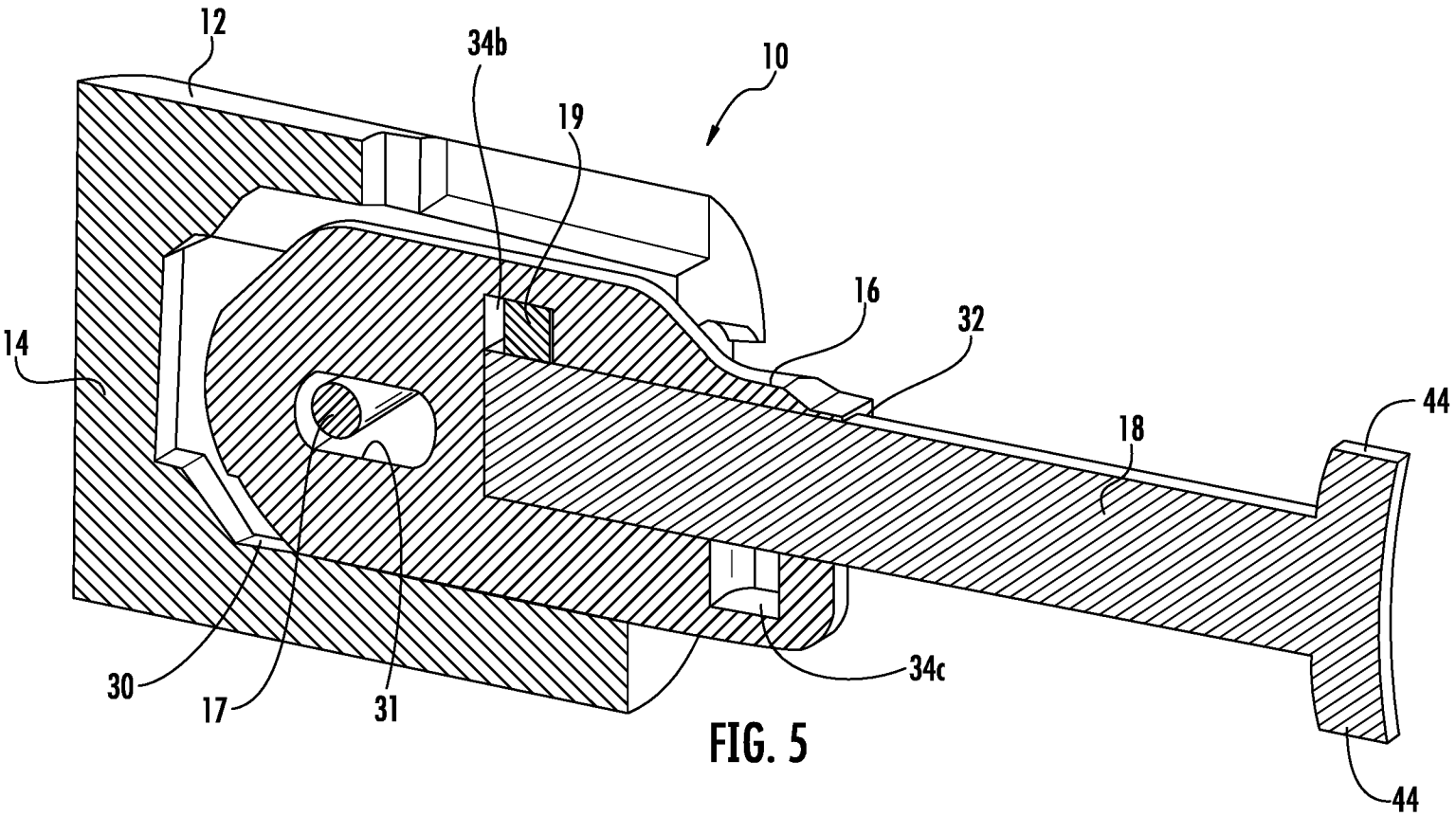
FIG. 5 is a perspective section view of the cylindrical latch as shown in FIG. 4 as taken along a vertical cutting plane 5-5 of FIG. 1 through the longitudinal axis of the cylindrical latch.
Figure 16:
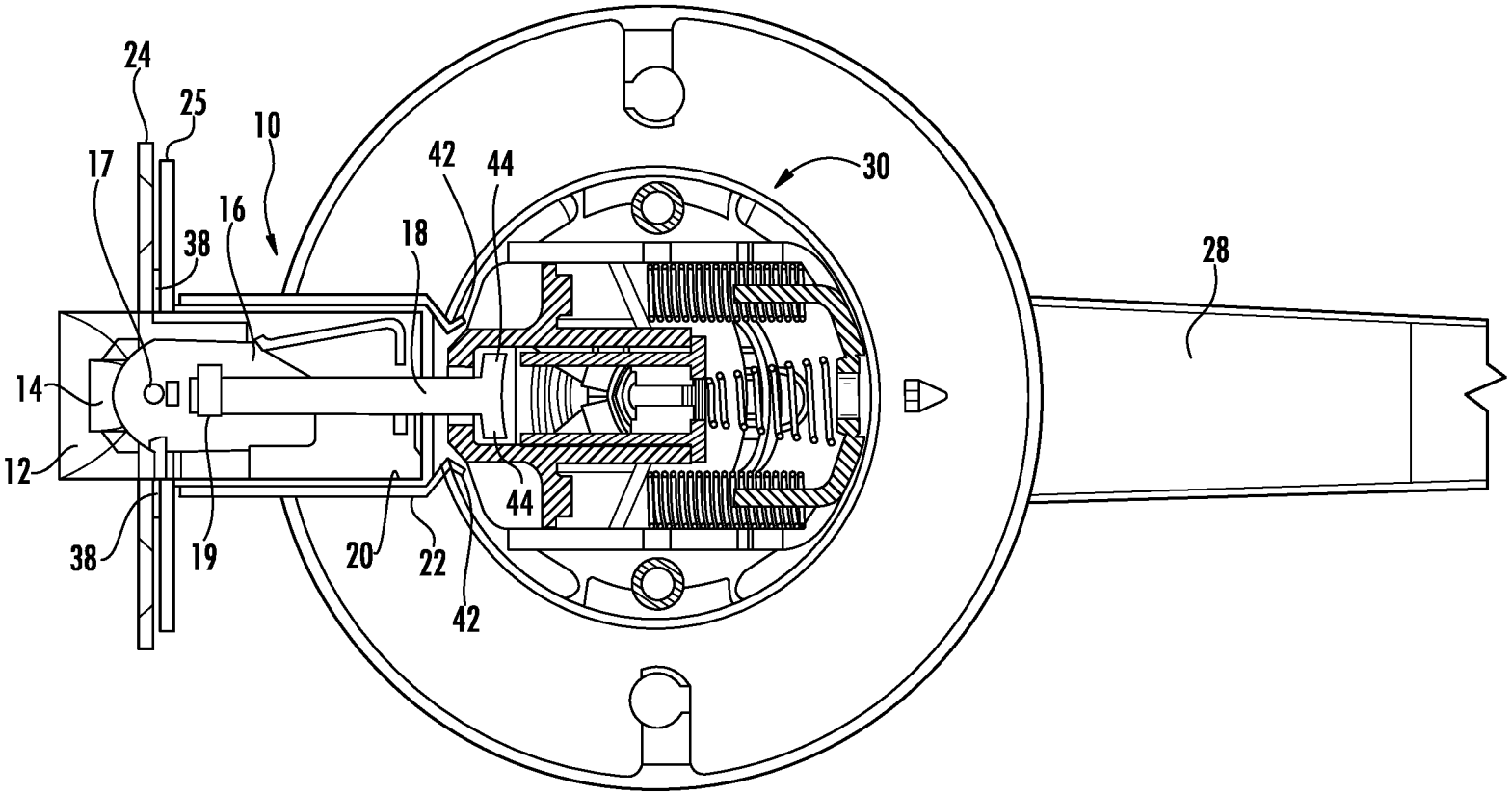
FIG. 16 is a vertical cross-section of a lockset and the adjustable backset cylindrical latch showing the adjustable backset cylinder latch schematically to illustrate the operative connection between the adjustable backset cylinder latch as a lockset of FIG. 1.
Figure 17:
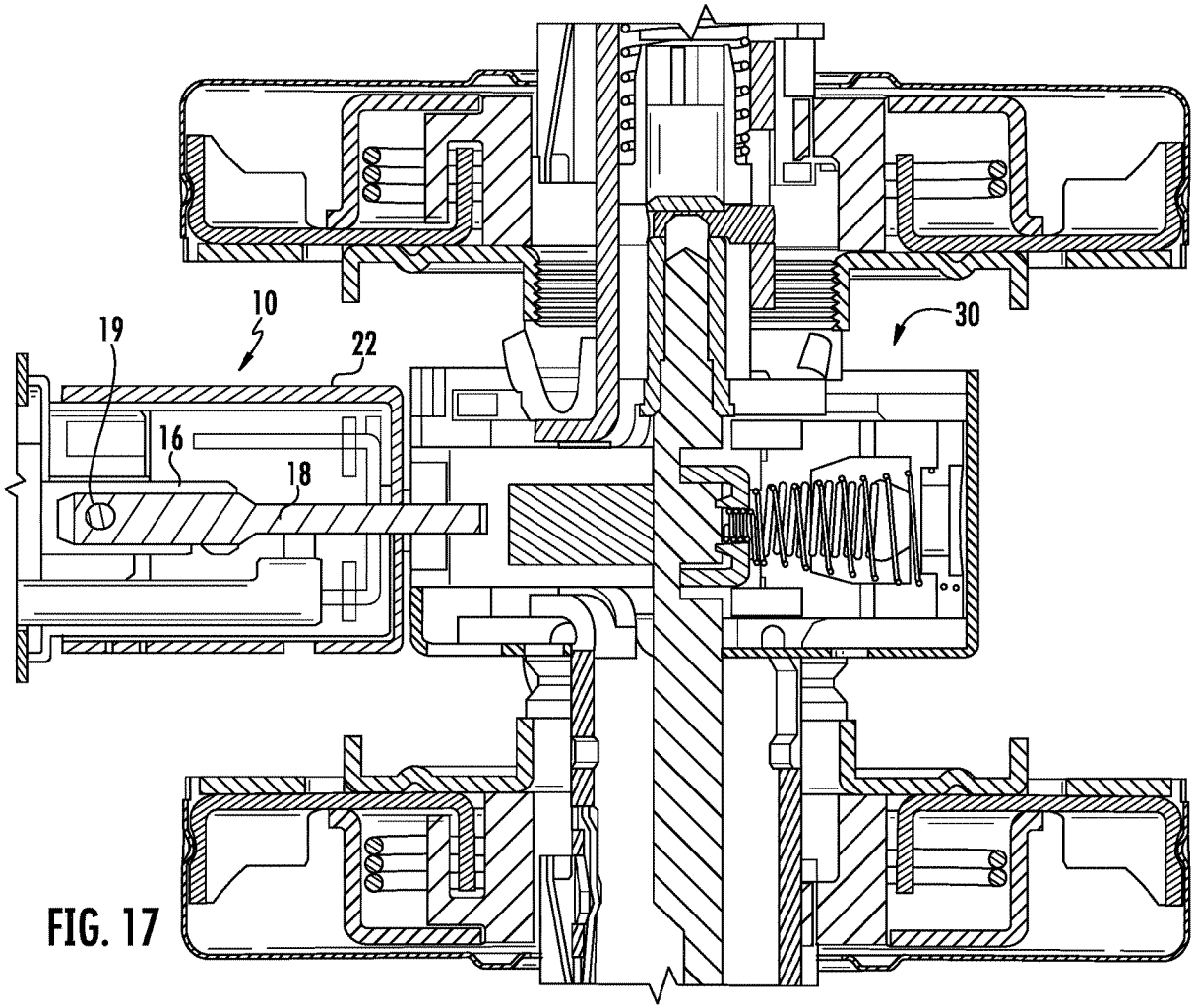
FIG. 17 is a horizontal cross-section of the lockset and adjustable backset cylinder latch of FIG. 16.

Referring to FIGS. 16 and 17, ears 42, 44 at the inner end of the outer case 22 of the adjustable backset cylindrical latch 10 and the inner end of the inner tailpiece 18 are in the same relative position for engagement with a latch retractor 30 of a commercial grade lockset. This conventional arrangement is shown in FIGS. 4, 7 and 8 of U.S. Application. No. 2009/0152875. Another prior art arrangement for a commercial grade lockset is shown in U.S. Application No. 2010/0307207. The contents of both U.S. Application. No. 2009/0152875 and U.S. Application No. 2010/0307207 are incorporated herein by reference in their entirety.

Moreover, because the outer tailpiece 16 and the inner tailpiece 18 are rigidly attached to the bolt head 12 for conjoined axial movement in both backset positions, the adjustable backset cylindrical latch 10 functions with a kickoff feature of the lockset. Kickoff is a required feature for certain lock applications in which it is desired that the lockset unlocks a locked door when the door is closed to prevent persons from becoming unintentionally locked out of a room. In use, when the bolt head 12 hits a strike plate (not shown) upon door closing and is pushed into the case, the inward motion of the bolt head 12 is transferred through the rigid connection at the outer tailpiece 16 via the pin 19 to the inner tailpiece 18. Since the inner tailpiece 18 is operatively connected to the retractor, the retractor is thus moved inwardly for unlocking the lockset. Therefore, the adjustable backset cylindrical latch 10 has a bolt tail configuration providing kickoff functionality in either backset position.

Although the adjustable backset cylindrical latch has been shown and described in considerable detail with respect to only a few exemplary embodiments thereof, it should be understood by those skilled in the art that we do not intend to limit the latch to the embodiments since various modifications, omissions and additions may be made to the disclosed embodiments without materially departing from the novel teachings and advantages, particularly in light of the foregoing teachings. Accordingly, we intend to cover all such modifications, omission, additions and equivalents as may be included within the spirit and scope of the cylindrical latch as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An adjustable latch assembly for use with installations having a first backset and installations having a second backset, the latch assembly comprising:

a latch bolt;

a tailpiece including a first tailpiece member having a first end mounted to the latch bolt, the first tailpiece member defining a longitudinal bore having two axially spaced transverse recesses interconnected by a longitudinal passage, and a second tailpiece member having a first end configured to be movably received in the bore of the first tailpiece member and a second end adapted to be operably connected to the latch operator, the first end of the second tailpiece member received in one of the two axially spaced recesses in a first backset position and in the second of the two axially spaced recesses in a second backset position such that the second end of the second tailpiece member is axially spaced relative to the first tailpiece member from the first backset position, the second tailpiece member being rotatable relative to the first tailpiece member, wherein relative axial movement between the first tailpiece member and the second tailpiece member is prevented in a first relative rotational position of the tailpiece in the first backset position and a second relative rotational position of the tailpiece in the second backset position, and wherein relative axial movement of the second tailpiece member relative to the first tailpiece member is allowed in a third relative rotational position of the tailpiece to allow the second tailpiece member to be movable along the longitudinal passage between the first backset position and the second backset position;

a housing for slidably receiving the latch bolt therein, the housing including a transversely extending protrusion; and a casing defining a peripheral slot having two axially spaced circumferential portions interconnected by a longitudinal portion, the casing configured for slidably receiving the housing such that the protrusion on the housing is received in the slot, the protrusion received in one of the two axially circumferential portions in the first backset position and in the second of the two axially spaced circumferential portions in the second backset position such that the casing is axially spaced relative to the latch bolt from the first backset position, the casing being rotatable relative to the housing, wherein relative axial movement between the casing and the housing is prevented when the protrusion is in either one of the two circumferential portions of the slot in a first relative rotational position of the housing in the first backset position and a second relative rotational position of the housing in the second backset position, and wherein relative axial movement of the casing relative to the housing is allowed in a third relative rotational position of the housing to allow the protrusion on the housing to be movable along the longitudinal passage between the circumferential portions of the slot when transitioning between the first backset position and the second backset position.

2. The latch assembly as recited in claim 1, further comprising a transverse pin disposed in the first end of the second tailpiece member, the pin configured to be slidable in the bore in the first tailpiece member.

3. The latch assembly as recited in claim 1, wherein an inner end of the casing defines an opening, and the inner end of the inner tailpiece member extends for non-rotatable relative axial movement from the opening such that the inner tailpiece member and the casing rotate together.

4. A lockset for use in an edge of a swinging door, the lockset comprising:

a latch operator having a rotational axis; and an adjustable latch assembly adjustable for use with installations having a first backset and installations having a second backset, the latch assembly comprising a latch bolt, a tailpiece including a first tailpiece member having a first end mounted to the latch bolt, the first tailpiece member defining a longitudinal bore having two axially spaced transverse recesses interconnected by a longitudinal passage, and a second tailpiece member having a first end configured to be movably received in the bore of the first tailpiece member and a second end adapted to be operably connected to the latch operator, the first end of the second tailpiece member received in one of the two axially spaced recesses in a first backset position and in the second of the two axially spaced recesses in a second backset position such that the second end of the second tailpiece member is axially spaced relative to the first tailpiece member from the first backset position, the second tailpiece member being rotatable relative to the first tailpiece member, wherein relative axial movement between the first tailpiece member and the second tailpiece member is prevented in a first relative rotational position of the tailpiece in the first backset position and a second relative rotational position of the tailpiece in the second backset position, and wherein relative axial movement of the second tailpiece member relative to the first tailpiece member is allowed in a third relative rotational position of the tailpiece to allow the second tailpiece member to be movable along the longitudinal passage between the first backset position and the second backset position, a housing including a transversely extending protrusion, the housing adapted to disposed in the edge of the door for slidably receiving the latch bolt therein, a casing defining a peripheral slot having two axially spaced circumferential portions interconnected by a longitudinal portion, the casing adapted to be disposed in the edge of the door and configured for slidably receiving the housing such that the protrusion on the housing is received in the slot, the protrusion received in one of the two axially circumferential portions in the first backset position and in the second of the two axially spaced circumferential portions in the second backset position such that the casing is axially spaced relative to the latch bolt from the first backset position, the casing being rotatable relative to the housing, wherein relative axial movement between the casing and the housing is prevented when the protrusion is in either one of the two circumferential portions of the slot in a first relative rotational position of the housing in the first backset position and a second relative rotational position of the housing in the second backset position, and wherein relative axial movement of the casing relative to the housing is allowed in a third relative rotational position of the housing to allow the protrusion on the housing to be movable along the longitudinal passage between the circumferential portions of the slot when transitioning between the first backset position and the second backset position.

5. The lockset as recited in claim 4, further comprising a transverse pin disposed in the first end of the second tailpiece member, the pin configured to be slidable in the bore in the first tailpiece member.

6. The lockset as recited in claim 4, wherein the inner end of the casing defines an opening, and the inner end of the inner tailpiece member extends for non-rotatable relative axial movement from the opening such that the inner tailpiece member and the casing rotate together.

7. An apparatus for allowing passage through an opening, the apparatus comprising:

a door adapted to be mounted along one edge in the opening for swinging movement between an open position and a closed position;

a lockset configured to be disposed in an edge of the door opposite the mounted edge, the lockset comprising a latch operator having a rotational axis; and an adjustable latch assembly adjustable for use with installations having a first backset and installations having a second backset, the latch assembly comprising a latch bolt, a tailpiece including a first tailpiece member having a first end mounted to the latch bolt, the first tailpiece member defining a longitudinal bore having two axially spaced transverse recesses interconnected by a longitudinal passage, and a second tailpiece member having a first end configured to be movably received in the bore of the first tailpiece member and a second end adapted to be operably connected to the latch operator, the first end of the second tailpiece member received in one of the two axially spaced recesses in a first backset position and in the second of the two axially spaced recesses in a second backset position such that the second end of the second tailpiece member is axially spaced relative to the first tailpiece member from the first backset position, the second tailpiece member being rotatable relative to the first tailpiece member, wherein relative axial movement between the first tailpiece member and the second tailpiece member is prevented in a first relative rotational position of the tailpiece in the first backset position and a second relative rotational position of the tailpiece in the second backset position, and wherein relative axial movement of the second tailpiece member relative to the first tailpiece member is allowed in a third relative rotational position of the tailpiece to allow the second tailpiece member to be movable along the longitudinal passage between the first backset position and the second backset position, a housing including a transversely extending protrusion, the housing disposed in the edge of the door for slidably receiving the latch bolt therein, a casing defining a peripheral slot having two axially spaced circumferential portions interconnected by a longitudinal portion, the casing disposed in the edge of the door and configured for slidably receiving the housing such that the protrusion on the housing is received in the slot, the protrusion received in one of the two axially circumferential portions in the first backset position and in the second of the two axially spaced circumferential portions in the second backset position such that the casing is axially spaced relative to the latch bolt from the first backset position, the casing being rotatable relative to the housing, wherein relative axial movement between the casing and the housing is prevented when the protrusion is in either one of the two circumferential portions of the slot in a first relative rotational position of the housing in the first backset position and a second relative rotational position of the housing in the second backset position, and wherein relative axial movement of the casing relative to the housing is allowed in a third relative rotational position of the housing to allow the protrusion on the housing to be movable along the longitudinal passage between the circumferential portions of the slot when transitioning between the first backset position and the second backset position.

8. The apparatus as recited in claim 7, further comprising a transverse pin disposed in the first end of the second tailpiece member, the pin configured to be slidable in the bore in the first tailpiece member.

9. The apparatus as recited in claim 7, wherein the inner end of the casing defines an opening, and the inner end of the inner tailpiece member extends for non-rotatable relative axial movement from the opening such that the inner tailpiece member and the casing rotate together.

* * * * *